US006312072B1

(12) United States Patent
Hough

(10) Patent No.: US 6,312,072 B1
(45) Date of Patent: Nov. 6, 2001

(54) DISABLING A PRINTING MECHANISM IN RESPONSE TO AN OUT OF INK CONDITION

(75) Inventor: James A. Hough, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 08/847,235

(22) Filed: May 1, 1997

(51) Int. Cl.[7] ..... B41J 2/195
(52) U.S. Cl. ..... 347/7
(58) Field of Search ..... 347/14, 19, 7, 347/86, 49

(56) References Cited

U.S. PATENT DOCUMENTS

| | | | | |
|---|---|---|---|---|
| 4,253,103 | | 2/1981 | Heinzl et al. | 346/140 R |
| 4,422,084 | | 12/1983 | Saito | 346/140 R |
| 4,514,742 | | 4/1985 | Suga et al. | 346/140 R |
| 4,604,633 | | 8/1986 | Kimura et al. | 346/140 R |
| 4,907,013 | * | 3/1990 | Hubbard et al. | 347/19 |
| 4,961,088 | | 10/1990 | Gilliland et al. | 355/206 |
| 4,970,533 | | 11/1990 | Saito et al. | 346/140 R |
| 5,132,711 | * | 7/1992 | Shinada et al. | 347/19 |
| 5,136,305 | | 8/1992 | Ims | 346/1.1 |
| 5,283,593 | | 2/1994 | Wehl | 346/140 R |
| 5,373,969 | | 12/1994 | Takemura | 222/147 |
| 5,517,217 | * | 5/1996 | Haselby et al. | 347/23 |
| 5,617,121 | * | 4/1997 | Tachihara et al. | 347/7 |
| 5,636,032 | * | 6/1997 | Springett | 358/296 |
| 5,680,521 | * | 10/1997 | Pardo et al. | 395/112 |
| 5,699,090 | * | 12/1997 | Wade et al. | 347/7 |
| 5,736,997 | * | 4/1998 | Bolash et al. | 347/19 |
| 6,116,715 | * | 9/2000 | Lefebvre et al. | 347/19 |

FOREIGN PATENT DOCUMENTS

| | | | |
|---|---|---|---|
| 0 219 847 A2 | 10/1986 | (EP) | G07B/17/00 |
| 0 574 182 A2 | 6/1999 | (EP) | B41J/2/175 |
| 2 740 728 | 11/1995 | (FR) | B41J/2/045 |
| 02165954 | 6/1999 | (JP) | B41J/2/01 |

* cited by examiner

*Primary Examiner*—John Barlow
*Assistant Examiner*—Michael S. Brooke
(74) *Attorney, Agent, or Firm*—Angelo N. Chaclas; Michael E. Melton

(57) ABSTRACT

An ink jet printer including a replaceable cartridge and a control device in operative communication with the cartridge. The control device is for monitoring a predetermined operating condition of the cartridge and providing electronic signals to the cartridge in response to the predetermined operating condition reaching a threshold level so as to disable the cartridge.

22 Claims, 4 Drawing Sheets

DISABLING A PRINTING MECHANISM IN RESPONSE TO AN OUT OF INK CONDITION

FIELD OF THE INVENTION

This invention relates to preventing unauthorized reuse of a printing mechanism after an out of ink condition. More particularly, this invention is directed to a postage printing apparatus including an ink jet printer having an ink jet cartridge wherein the postage printing apparatus disables the ink jet cartridge in response to an out of ink condition.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver electronics for controlling the ejection elements. Typically, the array of nozzles and the ejection elements along with their associated components are referred to as a print head. It is the activation of the ejection elements which causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. Some ink jet printers provide an indication to the user that the ink supply is running low while others do not. In either case, the printer continues to operate with the result being that the user must recognize when the ink supply is exhausted.

Ink jet printer manufacturers intend for the ink jet cartridges to be disposable. That is, the manufacturers recommend that the cartridges not be reused for a variety of reasons. One reason is that refilling the ink reservoir of the cartridge presents the risk that air will penetrate into the ink supply. Air bubbles in the ink lead to malfunctions of the printer in that the supply of ink to the ejection elements may be interrupted leading to a decrease in print quality as the print head misfires. Another reason is that refilling the ink reservoir of the cartridge presents the risk that an incompatible ink may be introduced into the cartridge. Whether bubble jet or piezoelectric technology is utilized for the ejection elements, the ink formulation is particularly adapted thereto. Furthermore, the ink formulation is also particularly adapted to each manufacturers' print head even if the same type of ejection element technology is used. An incompatible ink placed into the cartridge leads to malfunctions of the printer in that the print head is not designed to work with the incompatible ink. Here again, a decrease in print quality results.

Still another reason for not reusing cartridges which have a bubble jet print head is that the bubble jet print head is designed to be replaced. Bubble jet print heads operate in a caustic environment due to the repeated creation, expansion and contraction of the vapor bubble. Thus, the bubble jet print head only has a limited life. Generally, manufacturers design the print head to last only so long as the ink supply. In this manner, replacing the ink cartridge provides a new supply of ink and a new print head. Thus, replenishing the ink cartridge with ink may lead to a decrease in print quality due to the degradation of the bubble jet print head.

Recently, the postage meter industry and other envelope printing industries have begun to incorporate ink jet printers. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user paid to the Postal Service the amount of postage to be credited to the meter and the meter is recharged by increasing the setting of the descending register by the amount paid. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

With the incorporation of ink jet printing, postage printing devices now face the same problems associated with the reuse of ink jet cartridges as are found in general purpose ink jet printers. However, new problems also arise due to the inherent nature of printing an indicia of value. For example, if a general purpose ink jet printer runs out of ink while printing a document, then the user merely installs a new cartridge and reprints the document. On the other hand, if a postage printing device runs out of ink while printing a postal indicia, then the user loses money because the postal funds associated with that postal indicia cannot be recovered. As another example, if some of the ejection elements are not operating due to degradation of the ejection elements from reuse of the cartridge, then the postal indicia will suffer from reduced print quality, even if adequate amounts of ink are present, resulting in a loss of optical character recognition (OCR) readability and loss of sufficient fluorescence necessary to be detected by a facer/canceller apparatus as a valid postal indicia. This will likely result in the mailpiece being returned to the sender by the postal authority. Again, the user loses money because the postal funds associated with that postal indicia cannot be recovered.

Therefore, there is a need for preventing unauthorized reuse of an ink cartridge after an out of ink condition. More particularly, there is a need for a postage printing apparatus including an ink jet printer having an ink jet cartridge wherein the postage printing apparatus disables the ink jet cartridge in response to an out of ink condition. In this manner, the user does not suffer a loss of funds by continuing to operate the postage printing apparatus or by reusing the ink cartridge and suffering a degradation of print quality.

SUMMARY OF THE INVENTION

The present invention provides an apparatus for preventing unauthorized reuse of an ink cartridge after an out of ink condition. Conventionally, this invention may be incorporated into a variety of devices employing ink jet printing, such as: a postage meter mailing machine, a postage meter, a postage printing device or a general purpose ink jet printer.

In accordance with the present invention, there is provided an ink jet printer including a replaceable cartridge and a control device in operative communication with the cartridge. The control device monitors a predetermined operating condition of the cartridge and provides electronic signals to the cartridge in response to the predetermined operating condition reaching a threshold level so as to disable the cartridge.

In accordance with the present invention, a method of operating an ink jet printer is provided comprising the step(s) of: providing a replaceable cartridge; monitoring a predetermined operating condition of the cartridge; and providing electronic signals to the cartridge in response to the predetermined operating condition reaching a threshold level so as to disable the cartridge.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Postage meter mailing machines are well known in the art. Generally, postage meter mailing machines are readily available from manufacturers such as Pitney Bowes Inc. of Stamford, Conn. Postage meter mailing machines often include a variety of different modules which automate the processes of producing mailpieces. The typical postage meter mailing machine includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying evidence of postage, accounting for postage used and stacking finished mailpieces. However, the exact configuration of each postage meter mailing machine is particular to the needs of the user. Customarily, the postage meter mailing machine also includes a transport apparatus which feeds the mailpieces in a path of travel through the successive modules of the postage meter mailing machine.

Figure 1:
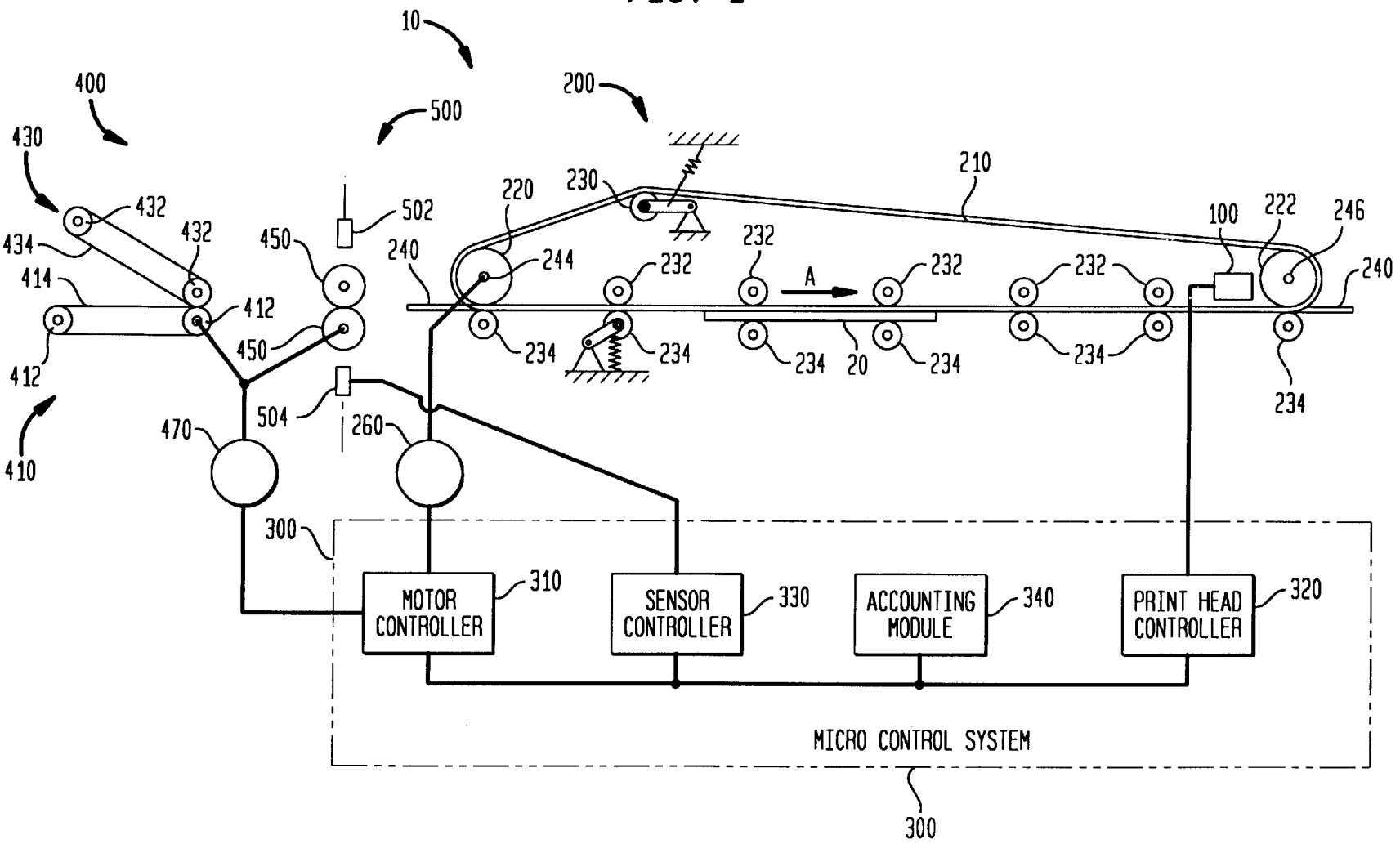
FIG. 1 is a simplified schematic of a front elevational view of a postage meter mailing machine which incorporates the present invention.

Referring to FIG. 1, an example of a postage meter mailing machine 10 in which the present invention may be incorporated is shown. The postage meter mailing machine 10 includes a printer module 100, a conveyor apparatus 200, a micro control system 300 and a singulator module 400. Other modules of the postage meter mailing machine 10, such as those described above, have not been shown for the sake of clarity. The singulator module 400 receives a stack of envelopes (not shown), or other mailpieces such as postcards, folders and the like, and separates and feeds them in a seriatim fashion (one at a time) in a path of travel as indicated by arrow A. Downstream from the path of travel, the conveyor apparatus 200 feeds the envelopes 20 in the path of travel along a deck 240 past the printer module 100 so that a postal indicia can be printed on each envelope 20. Together, the singulator module 400 and the conveyor module 200 make up a transport apparatus for feeding the envelopes 20 through the various modules of the postage meter mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

Since the details of the singulator module 400 are not necessary for an understanding of the present invention, no further description will be provided. However, an example of a singulator module suitable for use in conjunction with the present invention is described in U.S. Pat. No. 4,7978,114, entitled REVERSE BELT SINGULATING APPARATUS, the disclosure of which is specifically incorporated herein by reference.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The postage meter mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector 504 are located in opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck 240. This is commonly referred to as top surface registration which is beneficial for ink jet printing. Any variation in thickness of the envelope 20 is taken up by the deflection of the normal force rollers 234. Thus, a constant space (the distance between the printer module 100 and the deck 240) is set between the envelope 20 and the printer module 100 no matter what the thickness of the envelope 20. The constant space is optimally set to a desired value to achieve quality printing. It is important to note that the deck 240 contains suitable openings (not shown) for the endless belt 210 and normal force rollers 234.

A more detailed description of the conveyor apparatus 200 is found in copending U.S. patent application Ser. No. 08/717,788; filed on Sep. 23, 1996, and entitled MAILING MACHINE (Attorney Docket E-516), the disclosure of which is specifically incorporated herein by reference.

Figure 2:
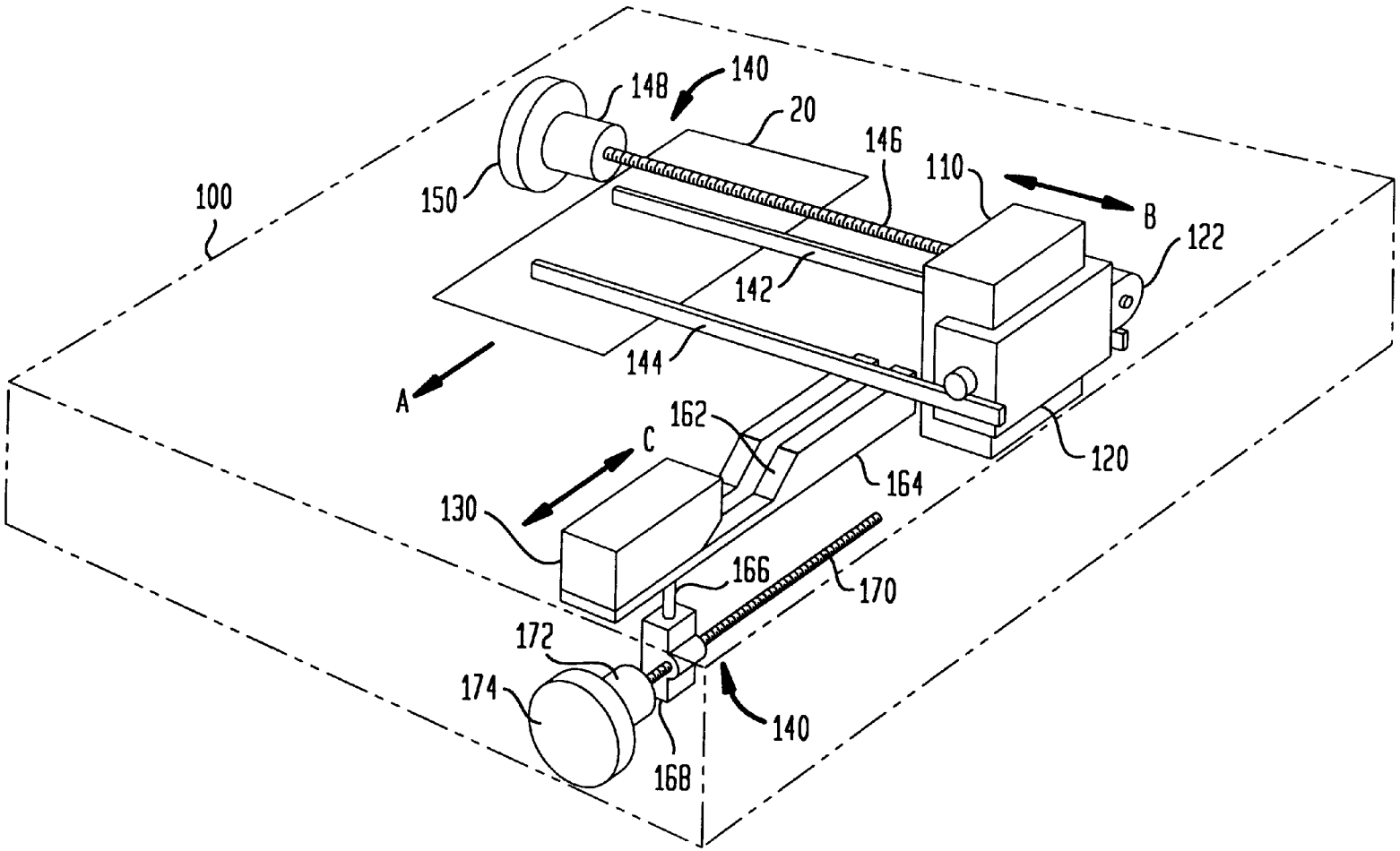
FIG. 2 is a simplified schematic of a perspective view of a printer module including a print cartridge in accordance with the present invention.

Referring to FIG. 2, the printer module 100 includes a carriage 120, an ink jet cartridge 110 detachably mounted to the carriage 120 in any conventional fashion, a maintenance assembly 130 and an assembly 140 for repositioning the carriage 120 and the maintenance assembly 130 into and out of operative engagement. The maintenance assembly 130 operates to wipe and cap the cartridge 110 in conventional fashion. The print module 100 further includes suitable framework (not shown) for supporting the various components of the print module 100.

The printer module 100 is used for printing a postal indicia on the envelope 20, which travels in the direction indicated by the arrow A. The repositioning assembly 140 includes a pair of rails 142 and 144, respectively, on which the carriage 120 rests. A lead screw 146 is driven by a drive motor 148 and threadingly engages a nut 122 fixably attached to the carriage 120 in order to translate the carriage 120 back and forth along the rails 142 and 144 as indicated by the double sided arrow B. A conventional encoder system 150 is operatively connected to the drive motor 148 for providing signals indicative of the position of the carriage 120 along the lead screw 146. The carriage 120 can be stopped at various positions along the lead screw 146 depending upon whether the cartridge 110 is printing or engaged with the maintenance assembly 130.

The repositioning assembly 140 further includes suitable structure for repositioning the maintenance assembly 130. The maintenance assembly 130 travels along a track 164 having a camming surface 162 as indicated by the double sided arrow C. A pin 166 engages an aperture (not shown) in the maintenance assembly 130 to reposition the maintenance assembly 130 along the track 164. The pin 166 is seated in a block 168 which threadingly engages a lead screw 170 which in turn is driven by a drive motor 172. Additionally, a conventional encoder system 174 is operatively connected to the drive motor 172 for providing signals indicative of the position of the maintenance assembly 130 along the lead screw 170. The maintenance assembly 130 can be stopped at various positions along the lead screw 170 depending upon whether the cartridge 110 is printing or engaged with the maintenance assembly 130.

Figure 3:
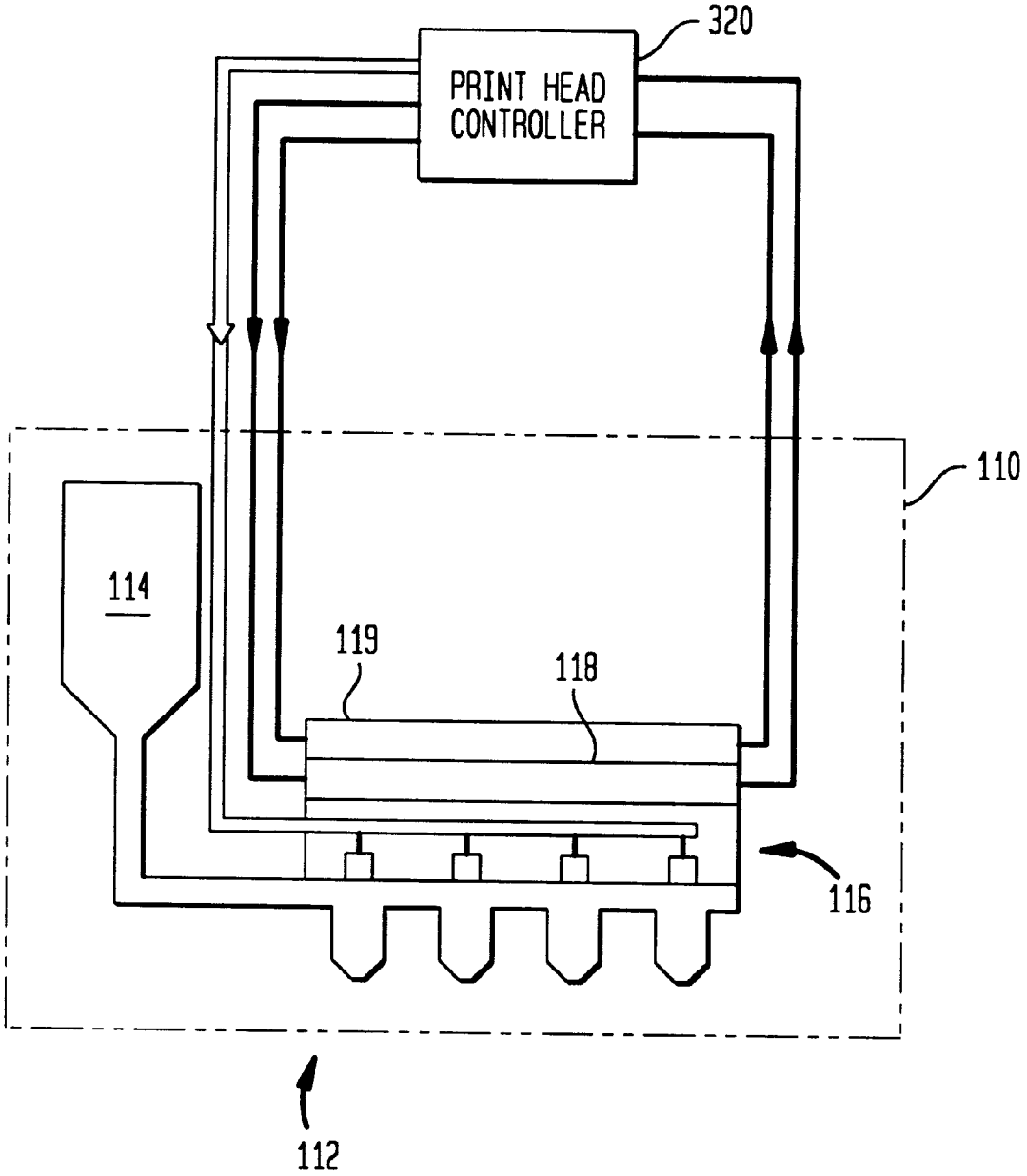
FIG. 3 is a more detailed schematic of the print cartridge in accordance with the present invention.

Referring to FIG. 3, a more detailed view of the ink jet cartridge 110 is shown. The ink jet cartridge 110 includes an array of nozzles 112, a supply of ink 114 and a plurality of ejection elements 116 connecting the array of nozzles 112 with ink supply 114, respectively. Activation of each of the ejection elements 116 is selectively controlled by suitable drive signals provided by the print head controller 320 which cause ink 114 to be expelled from the array of nozzles 112 in a predetermined manner. In the preferred embodiment, the plurality of ejection elements 116 are bubble jet type elements. The ink jet cartridge 110 further includes feed back devices in the form of a diode 118 and a resistor 119 which provide calibration information to the print head controller 320 as to the operating conditions of the cartridge 110. Since the diode 118 has a known operating behavior with respect to temperature, by applying a known voltage to the diode 118 and measuring the corresponding output current, the print head controller 320 can calculate the ambient temperature. In similar fashion, by applying a known voltage to the resistor 119 and measuring the corresponding output current, the print head controller 320 can calculate the sensitivity of the resistor 119 (sometimes referred to as a rank resistor). Both the ambient temperature and the resistor sensitivity are calibration inputs which are used to optimize the drive signals supplied to the ejection elements 116 to produce quality printed images. In the preferred embodiment, there is one diode 118 and one resistor 119 mounted directly to the silicone substrate which comprises the ejection elements 116. Those skilled in the art will recognize that each one of the ejection elements 116 could have its own diode and resistor or that the ejection elements 116 could be grouped into functional blocks with each block having its own diode and resistor.

Each cartridge 110 is initially filled with a predetermined amount of ink 114. Since ink 114 is used during printing and maintenance operations, the ink 114 will be gradually consumed over time and eventually a new cartridge 110 will need to be installed. To keep track of the amount of ink 114 available, the print head controller 320 estimates an amount of ink 114 used during operation and subtracts this amount from the initial predetermined amount to obtain an estimate of an amount of ink 114 remaining. Any conventional technique for estimating ink used, such as counting ink drops, may be employed. In this manner, the user can be instructed as to when the cartridge 110 should be replaced. In the alternative, a system (not shown), such as a thermistor in the ink reservoir, can be employed for actively measuring the amount of remaining ink.

Referring to FIG. 1, the singulator module 400, conveyor apparatus 200 and the printer module 100, as described above, are under the control of the micro control system 300 which may be of any suitable combination of microprocessors, firmware and software. The micro control system 300 includes a motor controller 310 which is in operative communication with the motors 260 and 470, a print head controller 320 which is in operative communication with the printer module 100, a sensor controller 330 which is in operative communication with the sensor module 500 and an accounting module 340 for authorizing and accounting for the dispensing of postal funds. The motor controller 310, the print head controller 320, the sensor controller 330, the accounting module 340 and other various components of the micro control system 300 are all in operative communication with each other over suitable communication lines.

Figure 4:
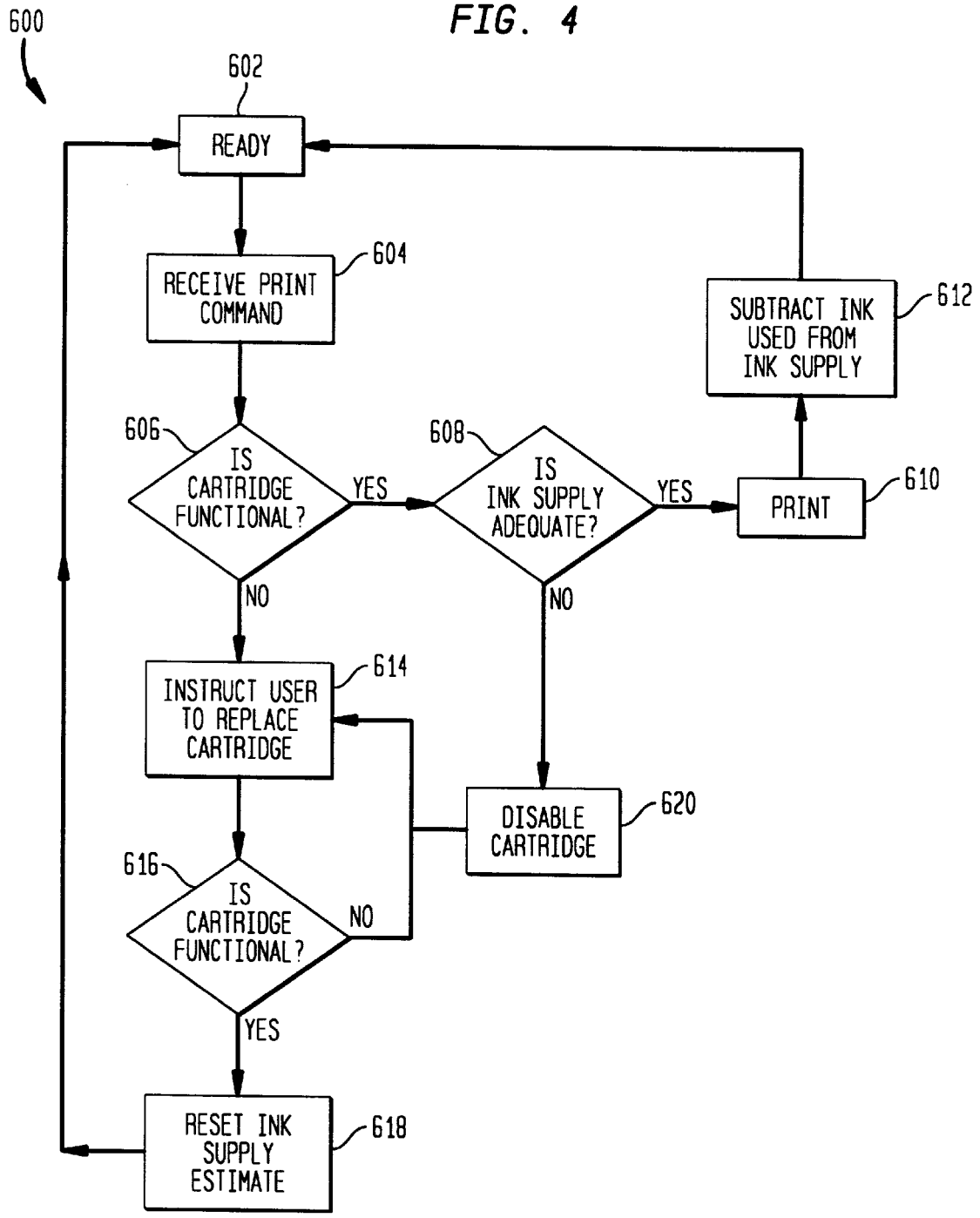
FIG. 4 is a flow chart showing the operation of the postage meter mailing machine in accordance with the present invention.

With the structure of the postage meter mailing machine 10 described as above, the operational characteristics will now be described. Referring primarily to FIG. 4 while referencing the structure of FIGS. 1, 2 and 3, a flow chart 600 of the operation of the postage meter mailing machine 10 in accordance with the present invention is shown. At 602, the postage meter mailing machine 10 is in a ready state waiting for the user to feed an envelope 20 or command some other function. At 604, the micro control system 300 generates a print command in response to the user feeding the envelope 20 or requesting a tape (not shown). Then, at 606, a determination is made as to whether the cartridge 110 is functional. This involves evaluating the feedback signals from the diode 1 18 and the resistor 119 to determine if both are within an acceptable range and measuring the impedance of each of the ejection elements 116 to determine if they are operational. If the print head controller 320 recognizes that the feedback signals which are outside of the acceptable range, then the print head controller 320 will interpret the ink cartridge 110 as not functional and not allow any printing to take place. If the print head controller 320 recognizes that more than a threshold number of the ejection elements 116 are not operational, then the print head controller 320 will interpret the ink cartridge 110 as not functional and not allow any printing to take place. On the other hand, if the feed back signals are within acceptable ranges and the number of the ejection elements 116 that are not operational is below the threshold number, then the print head controller 320 interprets the ink cartridge 110 as not functional and calibrates the drive signals accordingly for optimum print quality. Thus, if, at 606, the cartridge 110 is functional, then, at 608, a determination is made as to whether the amount of ink 114 remaining is sufficient to complete the printing operation demanded. Because the drive signals necessary to produce a desired image are known, the amount of ink required to produce the desired image is also known. Therefore, at 608, the amount of ink required is subtracted from the amount of ink remaining 114 to determine if the new amount of ink 114 remaining is sufficient (still above a threshold value). In the alternative, since the amount of ink required to produce the desired image is relatively constant from postal indicia to postal indicia, the required amount of ink could be factored into the threshold value directly. In this instance, the amount of ink remaining need only be compared to the threshold value. If yes, then, at 610, the postal indicia is printed and the corresponding amount of postal funds are debited from a descending register (not shown) in the accounting module 340. Then, at 612, the estimate of the amount of ink used is subtracted from the estimate of the amount of ink 114 remaining before control returns to 602.

On the other hand, if, at 608, the amount of ink 114 remaining is not sufficient, then, at 620, the cartridge 620 is disabled to prevent further printing. This may be accomplished in a variety of ways. First, the print head controller 320 can overdrive the diode 118 until a failure occurs. This can be achieved by applying an over load voltage (40 volts) to the diode 118 for a specified amount of time (0.5 seconds) to insure that the diode 118 fails. Alternatively, a more moderate voltage could be applied but at a continuous duty cycle to achieve the same result. Second, the resistor 119 can be burnt out in similar manner, by applying an over load voltage to the resistor 119 until failure is assured. Both of these techniques disable the cartridge 110 because after the diode 118 or resistor 119, as the case may be, is burnt out, the print head controller 320 will receive erroneous feedback signals which are outside of an acceptable range of signals. Thus, the print head controller 320 will recognize the cartridge 110 as not functional and not allow and printing to occur. Third, the ejection elements 116 can also be burnt out in similar fashion by over driving them (over load current, continuous duty cycle, etc.) until failure is assured. By measuring the impedance of the ejection elements 116, the print head controller 320 will recognize if the ejection elements 116 are functional.

After employing one of the techniques described above at 620, the user is instructed to replace the cartridge 110 at 614. Then, at 616, a determination is made as to whether a new cartridge 110 installed by the user is functional using the same techniques described above with respect to 606. If yes, then, at 618, the estimate of the amount of ink 114 remaining is reset to the initial amount before control returns to 602. On the other hand, if, at 616, the answer is no, then the user is again prompted at 614 to install a new cartridge 110. On the other hand, if, at 606, the cartridge is determined to not be functional, then control flows to 614 and operation proceeds as described above.

It is important to note that the accuracy of the printer module 100 or the print head controller 320, respectively, in estimating the amount of ink 114 remaining influences the determination as to whether or not the amount of ink 114 remaining is sufficient to complete the printing operation. Since printing must be disabled before the ink 114 actually runs out to prevent the loss of postal funds, some safety factor should be established. That is, if empirical testing or other measures show that estimates of the amount of ink 114 remaining are only accurate to within ±10% of the initial amount of ink 114 originally supplied at manufacture, then a suitable out of ink condition would be when 85% of the initial amount of ink 114 originally supplied at manufacture was consumed. This would represent a margin of safety of 5%. That is, under worst case conditions, 5% of the initial amount of ink 114 originally supplied at manufacture would still be present when the out of ink condition is established. Depending upon the accuracy of the amount of ink 114 remaining estimates and the amount of risk deemed appropriate with different safety factors, a wide variety of threshold values for an out of ink condition can be established. In any case, the threshold value at which the ink cartridge 110 is disabled is set to an amount of ink which is less than the amount of ink which was supplied to the cartridge 110 at manufacture.

Base on the above description and the associated drawings, it should now be apparent that the present invention insures: maintenance of high print quality and OCR readability; prevention of loss of postal funds and prevention of unauthorized reuse of cartridges.

Many features of the preferred embodiment represent design choices selected to best exploit the inventive concept as implemented in a postage meter mailing machine. However, those skilled in the art will recognize that various modifications can be made without departing from the spirit of the present invention. For example, the preferred embodiments are described with respect to bubble jet technology, however, those skilled in the art will readily be able to adapt the inventive concepts to piezoelectric technology.

As another example, the preferred embodiments are described with respect to a cartridge which includes an ink supply and the print head (ejection elements and nozzles) along with other associated components. However, those skilled in the art will recognize that the inventive concepts of the present invention can be adapted to other configurations of the ink supply and the print head. One configuration involves an ink supply contained within a replaceable cartridge while the print head is physically separated from the replaceable cartridge. Thus, in this configuration, it is the replaceable cartridge which needs to be disabled, not necessarily the print head.

As yet another example, the preferred embodiments are described with respect to those skilled in the art will readily be able to adapt the inventive concepts to monitor and respond to other conditions which may warrant disabling the cartridge, such as: loss of operation of a predetermined number of ejection elements. Various postal authorities around the world are contemplating requiring OCR readability of the postal indicia or bar codes places within the postal indicia so that the postal authorities may read authentication information contained within the postal indicia for the purpose of detecting fraudulent postal indicias. Still another requirement of various postal authorities is that the postal indicia be printed with fluorescent ink so that is may be detected by facer/canceller equipment. Thus, loss of operation of ejection elements also could result in a loss of postal funds due to loss of OCR or bar code readability and facer/canceller detection if the number of faulty ejection elements becomes too high with respect to the total number of ejection elements.

It is important to note that the OCR and bar code readability of the postal indicia and fluorescence detection is dependent upon the ink formulation and the density (drops per inch) of the printed postal indicia. Since the requirements of OCR and bar code readability are well known in the art, the specifics details of OCR and bar code readability have been limited to only that which is necessary for an understanding of the present invention.

Therefore, the inventive concept in its broader aspects is not limited to the specific details of the preferred embodiments but is defined by the appended claims and their equivalents.

What is claimed is:

1. An ink jet printer, comprising:

a replaceable cartridge including a plurality of nozzles in operative communication with a plurality of ejection elements, respectively, for expelling ink from the plurality of nozzles;

a control system in operative communication with the cartridge for:

monitoring a predetermined operating condition of the cartridge; and providing a plurality of drive signals to the plurality of ejection elements, respectively, in response to the predetermined operating condition reaching a threshold level so as to damage the plurality of ejection elements and disable the cartridge and prevent reuse of the cartridge.

2. The ink jet printer of claim 1, wherein:

the predetermined operating condition is an amount of ink remaining in the cartridge; and the threshold level is set to a value less than an amount of ink initially supplied in the cartridge at manufacture.

3. The ink jet printer of claim 2, wherein:

the control system subtracts an amount of ink required to produce a desired image from the amount of ink remaining and compares the result to the threshold level prior to printing; and if the result is less than the threshold level, then the control system provides electronic signals so as to disable the cartridge.

4. The ink jet printer of claim 3, wherein:

the plurality of ejection elements are of a bubble jet type;

the ink jet printer is a component of a postage dispensing device including an accounting means for storing postal funds, the accounting means being in operative communication with the control system; and the threshold value is set so that a risk of loss of postal funds due to running out of ink while printing a postal indicia is substantially eliminated.

5. The ink jet printer of claim 1, wherein:

the cartridge includes a plurality of nozzles in operative communication with a plurality of ejection elements, respectively, for expelling ink from the plurality of nozzles;

the predetermined operating condition is a functional status of the plurality of ejection elements in the cartridge; and the threshold level is set to a predetermined number of nonfunctional ejection elements above which print quality will be reduced to such an extent that readability by automated processes will be compromised.

6. The ink jet printer of claim 5, wherein:

to disable the cartridge, the control means provides a plurality of drive signals to the plurality of ejection elements, respectively, so as to damage the plurality of ejection elements.

7. The ink jet printer of claim 6, wherein:

the plurality of ejection elements are of a bubble jet type;

the ink jet printer is a component of a postage dispensing device including an accounting means for storing postal funds; and the threshold value is set so that a risk of loss of postal funds due to running out ink while printing a postal indicia is substantially eliminated.

8. An ink jet printer, comprising:

a replaceable cartridge including a feedback means, a plurality of nozzles and a plurality of ejection elements in operative communication with the plurality of nozzles, respectively, for expelling ink from the plurality of nozzles, the feedback means for providing calibration signals to the control system; and a control system in operative communication with the cartridge for:

monitoring a predetermined operating condition of the cartridge; and to disable the cartridge, providing a drive signal to the feedback means in response to the predetermined operating condition reaching a threshold level so as to damage the feedback means and prevent the cartridge from further printing.

9. The ink jet printer of claim 8, wherein:

the feedback means is a temperature diode.

10. The ink jet printer of claim 8, wherein:

the feedback means is a rank resistor.

11. The ink jet printer of claim 8, wherein:

the ink jet printer is a component of a postage dispensing device including an accounting means for storing postal funds; and the threshold value is set so that a risk of loss of postal funds due to printing a postal indicia lacking of readability by automated processes is substantially eliminated.

12. A method of operating an ink jet printer, comprising the step(s) of:

providing a replaceable cartridge, the cartridge including a plurality of nozzles in operative communication with a plurality of ejection elements, respectively, for expelling ink from the plurality of nozzles;

monitoring a predetermined operating condition of the cartridge; and disabling and preventing reuse of the cartridge by providing a plurality of drive signals to the plurality of ejection elements, respectively, in response to the predetermined operating condition reaching a threshold level so as to damage the plurality of ejection elements.

13. The method of claim 12, wherein:

the predetermined operating condition is an amount of ink remaining in the cartridge; and further comprising the step(s) of:

setting the threshold level to a value less than an amount of ink initially supplied in the cartridge at manufacture.

14. The method of claim 13, further comprising the step(s) of:

subtracting an amount of ink required to produce a desired image from the amount of ink remaining and comparing the result to the threshold level prior to printing; and if the result is less than the threshold level, providing electronic signals so as to disable the cartridge.

15. The method of claim 14, wherein:

the plurality of ejection elements are of a bubble jet type;

the ink jet printer is a component of a postage dispensing device including an accounting means for storing postal funds; and further comprising the step(s) of:

setting the threshold value so that a risk of loss of postal funds due to running out of ink while printing a postal indica is substantially eliminated.

16. The method of claim 12, wherein:

the cartridge includes a plurality of nozzles in operative communication with a plurality of ejection elements, respectively, for expelling ink from the plurality of nozzles;

the predetermined operating condition is a functional status of the plurality of ejection elements in the cartridge; and further comprising the step(s) of:

setting the threshold level to a predetermined number of nonfunctional ejection elements above which print quality will be reduced to such an extent that readability by automated processes will be compromised.

17. The method of claim 16, further comprising the step(s) of:

providing a plurality of drive signals to the plurality of ejection elements, respectively, so as to damage the plurality of ejection elements to disable the cartridge.

18. The method of claim 17, wherein:

the plurality of ejection elements are of a bubble jet type;

the ink jet printer is a component of a postage dispensing device including an accounting means for storing postal funds; and further comprising the step(s) of:

setting the threshold value so that a risk of loss of postal funds due to running out ink while printing a postal Indicia is substantially eliminated.

19. A method of operating an ink jet printer, comprising the step(s) of:

providing a replaceable cartridge, the cartridge including a feedback means, a plurality of nozzles and a plurality of ejection elements being in operative communication with the plurality of nobles, respectively, for expelling ink from the plurality of nozzles, the feedback means for providing calibration signals used in driving the plurality of ejection elements;

monitoring a predetermined operating condition of the cartridge; and disabling the cartridge by providing a drive signal to the feedback means in response to the predetermined operating condition reaching a threshold level so as to damage the feedback means and prevent the cartridge from further printing.

20. The method of claim 18, wherein:

the feedback means is a temperature diode.

21. The method of claim 18, wherein:

the feedback means is a rank resistor.

22. The method of claim 18, wherein:

the ink jet printer is a component of a postage dispensing device including an accounting means for storing postal funds; and further comprising the step(s) of:

setting the threshold value so that a risk of loss of postal funds due to printing a postal indicia lacking of readability by automated processes is substantially eliminated.

* * * * *